US010202921B2

(12) United States Patent
Lavoisier

(10) Patent No.: US 10,202,921 B2
(45) Date of Patent: Feb. 12, 2019

(54) METHOD AND SYSTEM FOR SUPPLYING DIESEL TO A MOTOR VEHICLE

(71) Applicant: RENAULT S.A.S., Boulogne-Billancourt (FR)

(72) Inventor: Frederic Lavoisier, Paris (FR)

(73) Assignee: RENAULT S.A.S., Boulogne-Billancourt (FR)

( * ) Notice: Subject to any disclaimer, the term of this patent is extended or adjusted under 35 U.S.C. 154(b) by 60 days.

(21) Appl. No.: 15/032,461

(22) PCT Filed: Nov. 18, 2014

(86) PCT No.: PCT/FR2014/052946

§ 371 (c)(1),
(2) Date: Apr. 27, 2016

(87) PCT Pub. No.: WO2015/075368

PCT Pub. Date: May 28, 2015

(65) Prior Publication Data

US 2016/0245205 A1 Aug. 25, 2016

(30) Foreign Application Priority Data

Nov. 19, 2013 (FR) ..... 13 61328

(51) Int. Cl.
*F02D 41/04* (2006.01)
*F02D 41/38* (2006.01)
(Continued)

(52) U.S. Cl.
CPC ..... *F02D 41/042* (2013.01); *F02D 33/003* (2013.01); *F02D 41/3854* (2013.01); *F02M 37/08* (2013.01); *F02D 2200/701* (2013.01)

(58) Field of Classification Search
CPC ..... F02D 19/0618; F02D 2200/0602; F02D 2200/701; F02D 33/003; F02D 41/042;
(Continued)

(56) References Cited

U.S. PATENT DOCUMENTS 5,327,872 A 7/1994 Morikawa
2001/0023683 A1* 9/2001 Nakamura ..... F02D 41/042 123/457
(Continued)

FOREIGN PATENT DOCUMENTS

DE 10 2010 001 834 A1 4/1994
DE 10 2005 028 769 A1 12/2006
(Continued)

OTHER PUBLICATIONS

International Search Report dated Feb. 6, 2015, in PCT/FR2014/052946 Filed Nov. 18, 2014.

*Primary Examiner* — John Zaleskas
(74) *Attorney, Agent, or Firm* — Oblon, McClelland, Maier & Neustadt, L.L.P.

(57) ABSTRACT

A method controls a system for supplying diesel fuel on a motor vehicle. The system includes a fuel tank, a first pump that is a low-pressure pump taking fuel from the tank and delivering the fuel to a second pump that is a high-pressure pump. The method includes controlling the first pump to regulate the quantity of fuel provided as a function of the needs of the second pump, and determining a geographical position of the vehicle. The first pump is controlled to a maximum pressure level when the vehicle is in one of several predefined probable stopping zones.

11 Claims, 1 Drawing Sheet

(51) Int. Cl.
*F02M 37/08* (2006.01)
*F02D 33/00* (2006.01)

(58) Field of Classification Search
CPC . F02D 41/3854; F02M 37/08; F02N 11/0837; F02N 2200/123
USPC ..... 123/179.4, 456, 457, 458, 497; 701/112, 701/113
See application file for complete search history.

(56) References Cited

U.S. PATENT DOCUMENTS

2002/0092505 A1* 7/2002 Rembold ..... F02M 37/0052 123/464
2003/0145830 A1* 8/2003 Joos ..... F02D 41/065 123/461
2004/0211395 A1* 10/2004 Greco ..... F02D 41/064 123/497
2006/0173593 A1* 8/2006 Anderson ..... B60W 20/15 701/36
2006/0207567 A1* 9/2006 Yamaguchi ..... B60W 10/30 123/431
2007/0028897 A1* 2/2007 Fukasawa ..... F02D 41/042 123/467
2007/0175459 A1 8/2007 Williams et al.
2007/0221173 A1* 9/2007 Hazama ..... F02D 33/006 123/458
2007/0288154 A1 12/2007 Letang
2008/0218105 A1* 9/2008 Wunderlich ..... F02D 41/042 318/362
2009/0095259 A1* 4/2009 Pursifull ..... F02D 41/065 123/457
2009/0112423 A1* 4/2009 Foster ..... F16H 61/0031 701/60
2009/0247353 A1* 10/2009 Tryon ..... F16H 61/0031 477/20
2010/0145562 A1* 6/2010 Moran ..... B60K 6/46 701/22
2011/0005486 A1* 1/2011 Nakamura ..... F02N 11/0837 123/179.4
2011/0071746 A1* 3/2011 O'Connor Gibson ..... F02N 11/0837 701/101
2011/0153119 A1* 6/2011 Lee ..... F02N 11/0837 701/2
2011/0224884 A1 9/2011 Williams et al.
2012/0037122 A1* 2/2012 Veit ..... F02D 41/042 123/457
2012/0095670 A1* 4/2012 Piggott ..... F02D 17/04 701/112
2012/0136520 A1* 5/2012 Martin ..... B60W 10/06 701/22
2012/0143468 A1* 6/2012 Kim ..... F02N 11/0833 701/102
2013/0025569 A1 1/2013 Langenbach et al.
2013/0144507 A1* 6/2013 Lee ..... F02D 41/3082 701/103
2013/0158838 A1* 6/2013 Yorke ..... B60W 10/06 701/103
2013/0332054 A1* 12/2013 Kristinsson ..... F02N 11/0837 701/113
2014/0251292 A1 9/2014 Williams et al.

FOREIGN PATENT DOCUMENTS

DE 10 2006 052 418 A1 12/2007
DE 10 2007 048 517 A1 4/2009
DE 10 2010 027 937 A1 10/2011
DE 10 2010 043 280 A1 5/2012
GB 2 271 810 A 4/1994

* cited by examiner

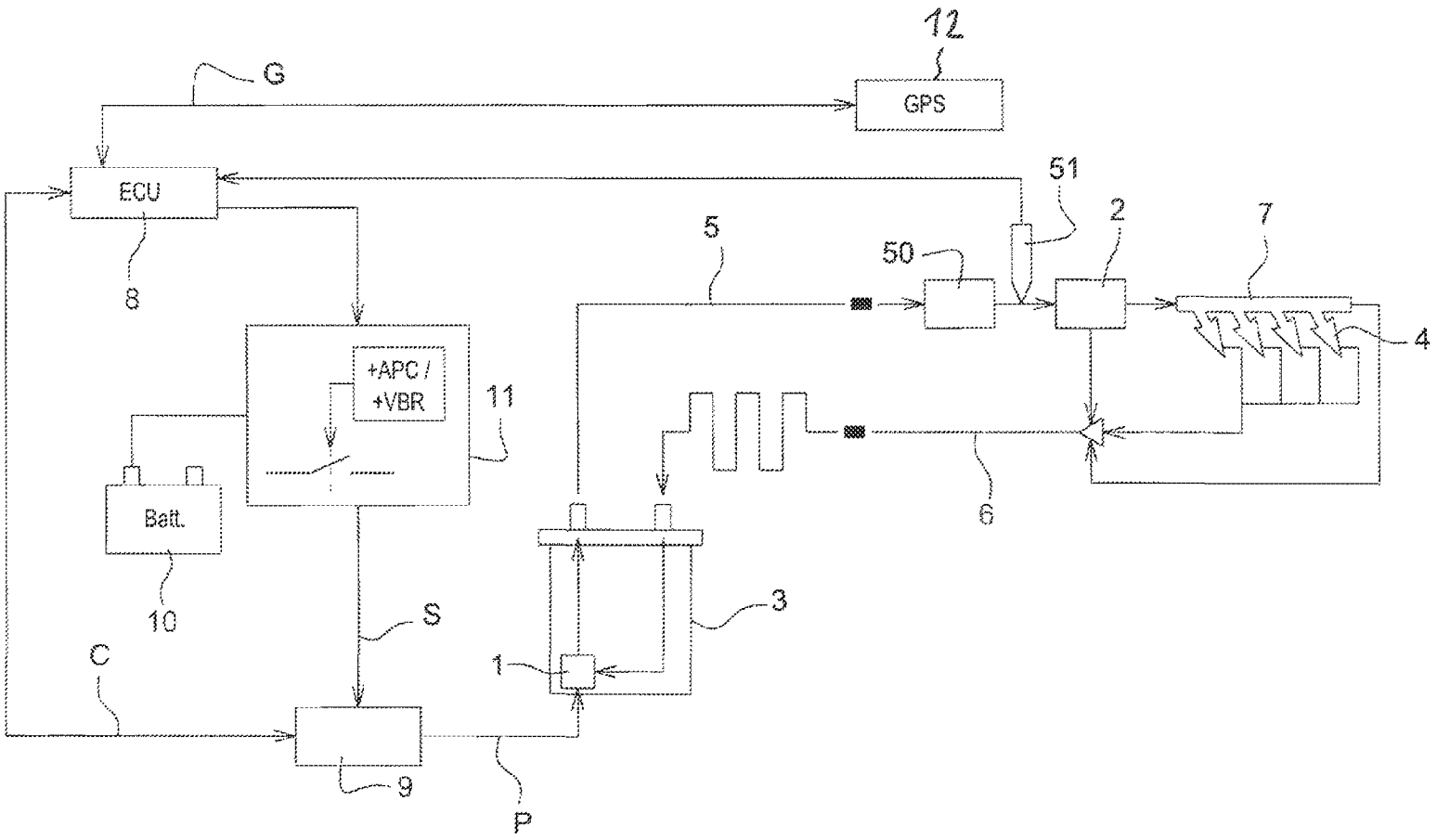
GPS
12
51
50
2
7
4
6
5
3
1
P
11
+APC /
+VBR
S
9
G
ECU
8
Batt.
10
C

METHOD AND SYSTEM FOR SUPPLYING DIESEL TO A MOTOR VEHICLE

TECHNICAL FIELD

The present invention concerns a method for supplying diesel to a motor vehicle and a supply system implementing said method.

PRIOR ART

Certain motor vehicles are fitted with a diesel fuel supply system comprising a fuel tank, a first pump called a low-pressure pump taking fuel from the tank and delivering it to a second pump called the high-pressure pump. The high-pressure pump supplies the injectors of the internal combustion engine. A return branch is provided to collect the surplus fuel arriving at various parts of the circuit and return it to the tank. To limit the electrical consumption on-board the vehicle, it is provided that the first pump is equipped with an electrical supply circuit which receives a proportional reference signal and which causes the first pump to run at variable speed. The reference signal is calculated by a control unit in order to regulate the fuel pressure upstream of the second pump at a constant level.

The second pump is generally driven directly by the engine via a mechanical link. It is lubricated by the circulation of diesel.

When the vehicle stops, in certain electrical architectures of the vehicle, the electrical power to the first pump is cut as soon as the vehicle stop command is given. The internal combustion engine stops progressively, continuing to run by inertia during a period of the order to 1 to 2 seconds. However, the first pump stops very quickly and the pressure in the circuit upstream of the second pump falls before the engine stops, for example within a period of one second. From this moment, the second pump is no longer supplied with fuel and therefore no longer lubricated, while it continues to be driven by the engine. There is therefore a risk of premature wear of the second pump.

The object of the invention is thus to provide a method and a system for supplying diesel fuel which reduce the risk of wear on the high-pressure pump.

DESCRIPTION OF THE INVENTION

With these aims in mind, the object of the invention is a method for controlling a system for supplying diesel fuel on a motor vehicle, the system comprising a fuel tank, a first pump called the low-pressure pump taking fuel from the tank and delivering it to a second pump called the high-pressure pump, in which method the first pump is controlled to regulate the quantity of fuel provided as a function of the needs of the second pump, characterized in that the geographical position of the vehicle is determined and the first pump is controlled to a maximum pressure level if the vehicle is in one of several predefined probable stopping zones.

Operation of the pump at its maximum level allows the supply of fuel at as high a pressure as possible. When the pump stops, the pressure in the circuit diminishes. Since the starting level is higher, a pressure level allowing lubrication of the second pump is maintained for a longer period. The duration of operation of the second pump with inadequate lubrication is reduced, which extends its service life. The stopping positions of a vehicle are generally repetitive, for example when the main user drives from home to work or to a regular activity, to customary shopping areas or to visit relatives and friends. By memorizing these places, the vehicle can anticipate the stops so as to extend the life of the second pump without a significant impact on the electrical consumption.

According to one embodiment, the probable stopping zones are acquired by learning. When the vehicle stops, the current position is memorized and compared with the probable stopping zones already memorized. If stops in this same position are performed frequently, the vehicle then considers that this position corresponds to a probable stopping zone and adds it. Similarly, if no or few stops are performed during a long period in a probable stopping zone already recorded, said zone is deleted.

According to one embodiment, a probable stopping zone is a disc defined by the coordinates of a center and a radius around the center. A difference relative to the stored position of the center is tolerated for considering that the vehicle is in the probable stopping zone. The radius for example has a value of a few tens of meters.

In particular, learning is performed by acquisition of positions when the vehicle stops, and a stopping zone is added to the list of stopping zones if a predefined number of stops has taken place within a perimeter of predefined radius. The predefined radius may be different from that which defines the stopping zone. For example, the barycenter of stored stopping positions situated in the perimeter may be used to define the center of the probable stopping zone.

In a refinement, the maximum pressure level is applied only for a predefined duration. If the vehicle has not stopped after entering a probable stopping zone and after expiry of said predefined duration, it is considered that the probability of stopping has become low and optimization of the pressure level is authorized again in order to reduce the electrical consumption of the vehicle.

The object of the invention is also a system for supplying fuel on a motor vehicle, the system comprising a fuel tank, a first pump called the low-pressure pump taking fuel from the tank and delivering it to a second pump called the high-pressure pump, and a control unit controlling the first pump to regulate the quantity of fuel supplied by the first pump as a function of the needs of the second pump, characterized in that it comprises geolocation means for determining the position of the vehicle and supplying this to a control unit, the control unit being configured to implement the method as described above. The control unit may be dedicated to this application or perform other independent functions for the operation of the vehicle.

The invention also concerns a motor vehicle, characterized in that it comprises a fuel supply system as described above.

BRIEF DESCRIPTION OF THE FIGURES

The invention will be better understood and further features and advantages will appear from reading the description below, the description referring to FIG. 1 which is a diagrammatic view of a fuel supply system according to one embodiment of the invention.

DETAILED DESCRIPTION

A fuel supply system on-board a motor vehicle with an internal combustion engine of the diesel type, in accordance with one embodiment of the invention, conventionally comprises a diesel fuel tank 3, a first pump 1 called the low-pressure pump taking fuel from the tank 3 and delivering it to a second pump 2 called the high-pressure pump, via a first pipe 5 and a diesel filter 50. The second pump 2 supplies the injectors 4 of the internal combustion engine. It is lubricated by the circulation of diesel. The second pump 2 is driven directly by the engine via a mechanical link (not shown). A second pipe 6 is provided to collect the surplus fuel arriving at the second pump 2, at a common rail 7 or at the injectors 4, and return it to the tank 3.

The system also comprises a control unit 8 controlling the first pump 1 to run at a variable speed, in order to regulate the quantity of fuel provided by the first pump 1 as a function of the needs of the second pump 2. To do this, the system comprises a power circuit 9 receiving a signal C from the control unit 8, and an electrical power source S, and providing a control power P to the first pump 1. The electrical power source S supplies direct current. The signal C from the control unit 8 is for example a pulse width modulation signal. This could also be a signal varying between 0 and 10 V or between 4 and 20 mA. The power circuit 9 provides the control power P in the form of width-modulated pulses. The system also comprises a pressure sensor 51 between the diesel filter 50 and the second pump 2, in order to measure the diesel pressure and supply the measurement to the control unit 8. The control unit 8 is configured to regulate the measured diesel pressure to a reference value. The reference value is set at a constant level.

The electrical power source S is connected to a battery 10 via a relay 11. As soon as the vehicle stop command is given, the relay 11 opens and the electrical power S for the first pump 1 is cut. At the same time, no further command to open the injectors 4 is given, which leads to stoppage of the engine.

According to the invention, the system comprises geolocation means 12 for determining the position of the vehicle and supplying this to the control unit 8. The geolocation means 12 use for example the GPS system. The control unit 8 comprises a list of probable stopping zones and compares the current position G provided by the geolocation means 12 with various probable stopping zones on the list. If the control unit 8 determines that the current position G lies in at least one of the zones on the list, it controls the first pump 1 to a maximum pressure level by replacing the regulation command. It maintains the control at the maximum pressure level for a predefined duration, after which it returns to the control level determined by the pressure regulation upstream of the second pump 2.

The probable stopping zones are stored for example with the coordinates of a center and a radius around the center, so as to define the zone as a disc with this center and this radius.

Preferably, the probable stopping zones are acquired by learning. For this, the learning is performed by the acquisition of positions when the vehicle stops. A stopping zone is added to the list of stopping zones if a predefined number of stops has taken place within a same perimeter of predefined radius. Evidently, tests are performed to avoid defining multiple overlapping zones. Similarly, other tests are performed to "forget" zones in which no stop has taken place for a predefined duration, for example for several weeks or several months.

In operation, the control unit 8 receives information on the position G via the geolocation means 12 and compares this position to each zone on the list of probable stopping zones. If the current position G does not correspond to a zone, the control unit 8 applies the pressure regulation process upstream of the second pump 2 by acting on the control signal C sent to the power circuit 9. If the position corresponds to at least one of the zones, the control unit 8 stores the moment at which this correlation is found for the first time. It applies a control command C for the power circuit 9 to run the pump at maximum speed. The position of the vehicle is always monitored and the pressure regulation is resumed if the vehicle leaves the probable stopping zone. Similarly, the regulation is resumed on expiry of a predefined period from the moment memorized before.

When the engine stops, it and the second pump continue to run for a duration of around 1.5 s. In the same time, the relay 11 opens and the supply to the control circuit 9 and to the first pump 1 is cut. On application of the method according to the invention, the first pump stops around 1.25 s after the loss of power, whereas if the stoppage occurs outside a probable stopping zone, the first pump 1 stops in around 1 s. Lubrication of the second pump is thus maintained for a further 0.25 s, which could reduce its wear.

The invention is not limited to the embodiment which has just been described merely as an example. Variants may be found in the method of memorizing and defining the probable stopping zones, by the calculation of another distance, or by the design of another form of predefined zone, or as a function of actual stopping points.

The invention claimed is:

1. A method for controlling a system for supplying diesel fuel to an internal combustion engine on a motor vehicle, the internal combustion engine stopping in response to a stop command, the system comprising a fuel tank, a first pump that is a low-pressure pump taking fuel from the fuel tank and delivering the fuel to a second pump that is a high-pressure pump, the method comprising:

controlling, via a control unit of the motor vehicle, a pressure of the first pump to regulate a quantity of fuel provided by the first pump, the pressure being determined by the control unit as a function of needs of the second pump;

determining, via the control unit, that a geographical position of the motor vehicle is in a predefined probable stopping zone; and modifying, prior to the stop command being given to the internal combustion engine, the controlling by the control unit to set the pressure in the first pump to a maximum pressure level in response to the control unit determining that the geographical position of the motor vehicle is in the predefined probable stopping zone.

2. The method as claimed in claim 1, wherein the predefined probable stopping zone is one of several predefined probable stopping zones that are acquired by learning.

3. The method as claimed in claim 2, wherein the learning is performed by the motor vehicle acquiring positions when the motor vehicle stops, and a stopping zone is added, via the control unit of the motor vehicle, to a list of the several predefined probable stopping zones upon a predefined number of stops taking place within a perimeter of predefined radius.

4. The method as claimed in claim 3, wherein the control unit of the motor vehicle removes the stopping zone from the list of the several predefined probable stopping zones once no stop has taken place within the stopping zone for a predefined duration.

5. The method as claimed in claim 1, wherein the predefined probable stopping zone is a disc defined by the coordinates of a center and a radius around the center.

6. The method as claimed in claim 1, wherein the maximum pressure level is applied only for a predefined duration.

7. The method as claimed in claim 1, wherein the modifying is performed while the motor vehicle is moving.

8. The method as claimed in claim 1, wherein the modifying includes, after the pressure in the first pump is set to the maximum pressure level, monitoring the motor vehicle for a predefined duration and, when the motor vehicle has not stopped moving upon completion of the predefined duration, returning the controlling by the control unit to set the pressure in the first pump as a function of the needs of the second pump.

9. A system for supplying fuel on a motor vehicle, the system comprising:

a fuel tank;

a first pump that is a low-pressure pump taking fuel from the fuel tank and delivering it to a second pump that is a high-pressure pump;

a control unit that controls the first pump to regulate a quantity of fuel supplied by the first pump as a function of needs of the second pump; and geolocation means for determining a position of the motor vehicle and supplying the position to the control unit, the control unit being configured to implement the method according to claim 1.

10. The system for supplying fuel according to claim 9, wherein the geolocation means includes a global positioning system.

11. A motor vehicle, comprising:

the system for supplying fuel according to claim 9.

* * * * *